US006823952B1

(12) United States Patent
Mensa-Wilmot et al.

(10) Patent No.: US 6,823,952 B1
(45) Date of Patent: Nov. 30, 2004

(54) STRUCTURE FOR POLYCRYSTALLINE DIAMOND INSERT DRILL BIT BODY

(75) Inventors: Graham Mensa-Wilmot, Houston, TX (US); Tommy G. Ray, Houston, TX (US); Youhe Zhang, Houston, TX (US)

(73) Assignee: Smith International, Inc., Houston, TX (US)

( * ) Notice: Subject to any disclaimer, the term of this patent is extended or adjusted under 35 U.S.C. 154(b) by 219 days.

(21) Appl. No.: 09/697,789

(22) Filed: Oct. 26, 2000

(51) Int. Cl.[7] ..... E21B 10/52; E21B 10/56; E21B 10/58

(52) U.S. Cl. ..... 175/432; 175/428; 175/434

(58) Field of Search ..... 175/327, 425, 175/426, 428, 429, 434, 431, 432

(56) References Cited

U.S. PATENT DOCUMENTS

| | | | | | |
|---|---|---|---|---|---|
| 4,499,795 | A | * | 2/1985 | Radtke | 164/108 |
| 4,787,466 | A | * | 11/1988 | Tomlinson et al. | 175/432 |
| 4,794,994 | A | * | 1/1989 | Deane et al. | 175/393 |
| 4,889,017 | A | * | 12/1989 | Fuller et al. | 175/428 |
| 4,991,670 | A | * | 2/1991 | Fuller et al. | 175/428 |
| 5,111,895 | A | * | 5/1992 | Griffin | 175/374 |
| 5,348,109 | A | * | 9/1994 | Griffin | 175/428 |
| 5,373,908 | A | | 12/1994 | Pastusek | 174/431 |
| 5,505,273 | A | * | 4/1996 | Azar et al. | 175/428 |
| 5,662,183 | A | | 9/1997 | Fang | 175/374 |
| 6,006,846 | A | * | 12/1999 | Tibbitts et al. | 175/428 |
| 6,021,858 | A | * | 2/2000 | Southland | 175/393 |
| 6,220,117 | B1 | * | 4/2001 | Butcher | 175/425 |
| 6,248,447 | B1 | * | 6/2001 | Griffin et al. | 175/434 |
| 2001/0030063 | A1 | * | 10/2001 | Dykstra et al. | 175/57 |

OTHER PUBLICATIONS

European Search Report dated Jan. 2, 2003.

* cited by examiner

*Primary Examiner*—David Bagnell
*Assistant Examiner*—Jennifer H Gay
(74) *Attorney, Agent, or Firm*—Osha & May L.L.P.

(57) ABSTRACT

A method for forming a drill bit body is disclosed which comprises infiltrating powdered tungsten carbide with a binder alloy in a mold. The mold has therein at least one displacement adapted to form a mounting pad for a cutting element. The displacement comprises a substantially cylindrical body having a diameter selected to substantially conform to a radius of the cutting element and a projection adapted to form a relief groove under a position of a diamond table in the cutting element when the cutting element is mounted on the pad. The width of the relief groove is selected so that the relief groove extends back from an outer surface of the bit body at least about 40 percent of that portion of a thickness of the diamond table which does not extend past the outer surface.

7 Claims, 3 Drawing Sheets

STRUCTURE FOR POLYCRYSTALLINE DIAMOND INSERT DRILL BIT BODY

FIELD OF THE INVENTION

The invention is related to the field of fixed cutter bits used to drill wellbores through earth formations. More specifically, the invention is related to structures for, and methods for making, alloy bodies for polycrystalline diamond compact cutter drill bits.

BACKGROUND OF THE INVENTION

Fixed cutter drill bits known in the art include polycrystalline diamond compact (PDC) bits. The typical PDC bit includes a bit body which is made from powdered tungsten carbide infiltrated with a binder alloy within a suitable mold form. The particular materials used to form PDC bit bodies are selected to provide adequate toughness, while providing good resistance to abrasive and erosive wear. The cutting elements used on these bits are typically formed from a cylindrical tungsten carbide "blank" or substrate. A diamond "table" made from various forms of natural and/or synthetic diamond is affixed to the substrate. The substrate is then generally brazed or otherwise bonded to the bit body in a selected position on the surface of the body.

The materials used to form PDC bit bodies, in order to be resistant to wear, are very hard and are therefore difficult to machine. Therefore, the selected positions at which the PDC cutting elements are to be affixed to the bit body are typically formed substantially to their final shape during the bit body molding process. A common practice in molding PDC bit bodies is to include in the mold at each of the to-be-formed cutter mounting positions, a shaping element called a "displacement". A displacement is generally a small cylinder made from graphite or other heat resistant material which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

PDC bits known in the art have been subject to fracture failure of the diamond table, and/or separation of the diamond table from the substrate during drilling operations. One reason for such failures is compressive contact between the exterior of the diamond table and the proximate surface of the bit body under drilling loading conditions. One solution to this problem known in the art is to mount the cutting elements so that substantially all of the thickness of the diamond table is projected outward past the surface of the bit body. While this solution does reduce the incidence of diamond table failure, having the diamond tables extend outwardly past the bit body can cause erratic or turbulent flow of drilling fluid past the cutting elements on the bit. This turbulent flow has been known to cause the cutter mounting to erode, and to cause the bonding between the cutters and the bit body to fail, among other deficiencies in this type of PDC bit configuration. It is preferable to have the PDC cutters mounted so that they are substantially flush with the outer surface of the mounting position on the bit body.

What is needed is a structure for a PDC bit body which reduces diamond table failure, while retaining the benefits of flush mounting of the cutters on the bit body.

SUMMARY OF THE INVENTION

One aspect of the invention is a method for forming a drill bit body which comprises infiltrating powdered tungsten carbide with a binder alloy in a mold. The mold has therein at least one displacement adapted to form a mounting pad for a cutting element. The displacement comprises a substantially cylindrical body having a diameter selected to substantially conform to a radius of the cutting element and a projection adapted to form a relief groove under a position of a diamond table forming part of the cutting element when the cutting element is mounted on the pad. The width of the relief groove is selected so that the relief groove extends back from an outer surface of the bit body at least about 40 percent of that portion of a thickness of the diamond table which does not extend past the outer surface.

Another aspect of the invention is a drill bit body comprising a main body having at least one blade formed therein, and at least one cutting element mounting pad formed on the at least one blade. The mounting pad is adapted to receive therein a substrate of a cutting element. The mounting pad has a relief groove therein under a position of a diamond table in the cutting element when the cutting element is mounted on the pad. The width of the relief groove is selected so that the relief groove extends back from an outer surface of the blade at least about 40 percent of that portion of a thickness of the diamond table which does not extend past the outer surface.

Other aspects and advantages of the invention will be apparent from the following description and the appended claims.

DETAILED DESCRIPTION

A matrix drill bit body for a fixed cutter bit according to the various embodiments of the invention can be made from powdered tungsten carbide infiltrated with a binder alloy in a suitably shaped mold or other form. See, for example, U.S. Pat. No. 5,662,183 issued to Fang, incorporated herein by reference. In particular, the bit body forming process described in the Fang '183 patent includes insertion of plugs, called "displacements," in locations about the bit body on which cutting elements are to be mounted to the finished bit body. The locations at which cutting elements are to be mounted are referred to for convenience herein as "mounting pads".

Figure 1:
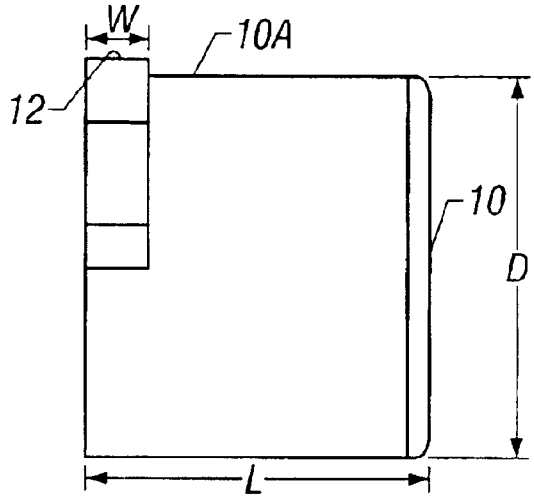
FIG. 1 shows a side view of one example of a displacement made according to the invention

In a drill bit body made according to the invention, displacements are inserted into the mold during the body forming process to produce mounting pads for the cutting elements. An example of a displacement according to one aspect of the invention is shown in FIG. 1. The displacement 10 in this embodiment is a substantially cylindrical body having a selected length indicated by L, a diameter indicated by D and on one end, a projection 12 having a selected width W. The length L and diameter D are selected to provide a mounting pad (not shown in FIG. 1) on the finished bit body (not shown in FIG. 1) having dimensions suitable to mount a selected cutting element (not shown in FIG. 1). Typically the cutting element (not shown in FIG. 1) affixed to the mounting pad will be a polycrystalline diamond compact insert. The projection 12 in this embodiment has a substantially cylindrical shape and extends laterally past the exterior surface 10A of the main body of the displacement 10 by about 0.025 inches (0.63 mm) in this embodiment. The displacement 10 is affixed to the mold (not shown in FIG. 1) so that the mounting pad is formed to have a recess or relief groove (not shown in FIG. 1) positioned under a diamond table forming part of the cutting element affixed to the mounting pad. The position of the relief groove and diamond table will be further explained.

Figure 2:
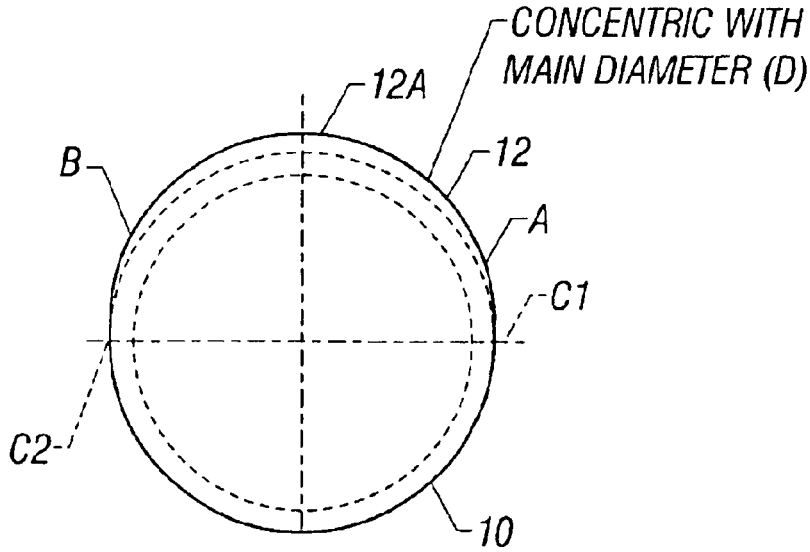
FIG. 2 shows an end view of a displacement such as shown in FIG. 1.

The example displacement is shown in an end view in FIG. 2, where the shape and lateral extent of the projection 12 can be seen. In this embodiment, the projection 12 has a primary surface 12A which extends laterally from the surface (10A in FIG. 1) of the displacement by about 0.025 inches (0.63 mm) and is substantially concentric with the surface (10A in FIG. 1) of the displacement 10 between points A and B. Transition surfaces, formed between endpoint A and point C1, and endpoint B and point C2 on the circumference of the displacement 10, can be formed to gradually adjust the radius of the exterior surface of the projection 12 to match the radius of the main surface 10A of the displacement 10. Typically, points C1 and C2 will be spaced about 180 degrees apart, so that the relief groove formed in the mounting pad will extend about 180 degrees. Other angular spacings of points C1 and C2, and endpoints A and B will also work with the invention, however.

The displacement 10 may be made from graphite or any other suitable material used for molding of matrix bodies. Using casting or cold pressing methods can be advantageous by enabling forming the displacement 10, including the projection 12 thereon, as a single piece.

As described in the Fang '183 patent, after the displacements are inserted into selected locations in the mold, powdered tungsten carbide is inserted into the mold and is then infiltrated with a binder alloy. Typically, the bit body thus formed will include "blades", each of which includes one or more of the mounting pads formed by the displacements.

Figure 3:
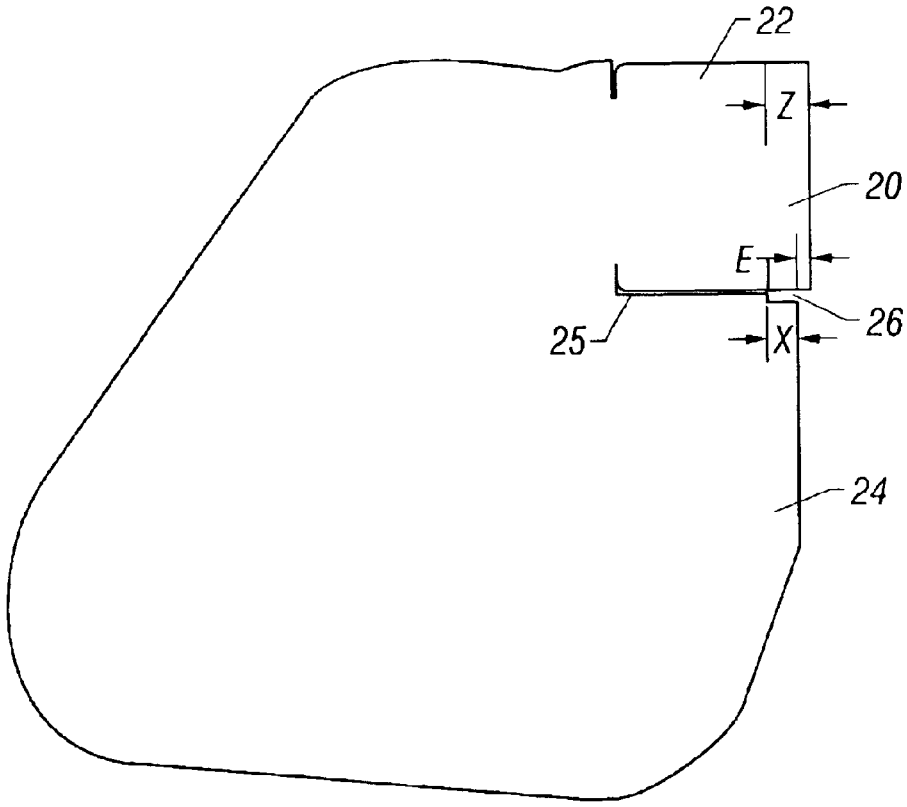
FIG. 3 shows a cross section of a drill bit body having a cutting element mounted on a pad made according to the invention.

A blade portion of a bit body formed using a displacement such as shown in FIGS. 1 and 2, is shown in cross section in FIG. 3. The blade 24 includes thereon a mounting pad 25 having the shape of the displacement (10 in FIG. 1). As previously explained, the radius of the mounting pad 25 is determined by the diameter (D in FIG. 1) of the displacement. Typically, this radius is selected to match the radius of the cutting element mounted thereon. As shown in FIG. 3, a relief groove 26 is formed in the mounting pad 25 by having placed the displacement (10 in FIG. 1) in the mold so that the projection (12 in FIG. 1) was positioned outward and downward with respect to the blade 24. Shown mounted in the pad 25 is a cutting element consisting of a diamond table 20 affixed to a substrate 22. Typically, the substrate 22 is formed from tungsten carbide or similar hard material. The diamond table 20 can be formed in any manner known in the art for making diamond cutting surfaces for fixed cutter drill bits. The cutting element is typically bonded to the blade 24 by brazing the substrate 22 to the blade 24.

In this embodiment, the diamond table 20 extends longitudinally past the surface of the blade 24 by an amount shown at E. The diamond table 22 has a thickness Z which is selected based on the diameter of the cutting element and the expected use of the particular drill bit, among other factors. In the invention, it has been determined that diamond table breakage is reduced efficiently when the width X of the relief groove 26 is selected so that the groove 26 extends back from the surface of the blade 24 at least about 40 percent of that portion (Z–E) of the thickness Z of the diamond table which does not extend past the edge of the blade 24. Expressed mathematically:

$$X/(Z-E) \geqq 0.40$$

In the example shown in FIG. 3, the diamond table thickness Z is about 0.110 inches (2.8 mm) and an extension E of the outer surface of the diamond table 22 past the edge of the blade 24 is about 0.040 inches (1 mm). The width X of the relief groove 25 should therefore be greater than or equal to about 0.028 inches (0.7 mm). As previously explained, the width Z of the relief groove 25 can be selected by appropriate choice of the width (W in FIG. 1) of the projection (12 in FIG. 1) on the displacement.

Preferably, the relief groove 25 has a depth of about 0.025 inches (0.6 mm). As previously explained, this depth can be formed in the bit body at the position of any or all of the mounting pads 24 by forming the displacement (10 in FIG. 2) so that the projection (12 in FIG. 2) extends past the main surface (10A in FIG. 2) by about 0.025 inches (0.6 mm).

Figure 4:
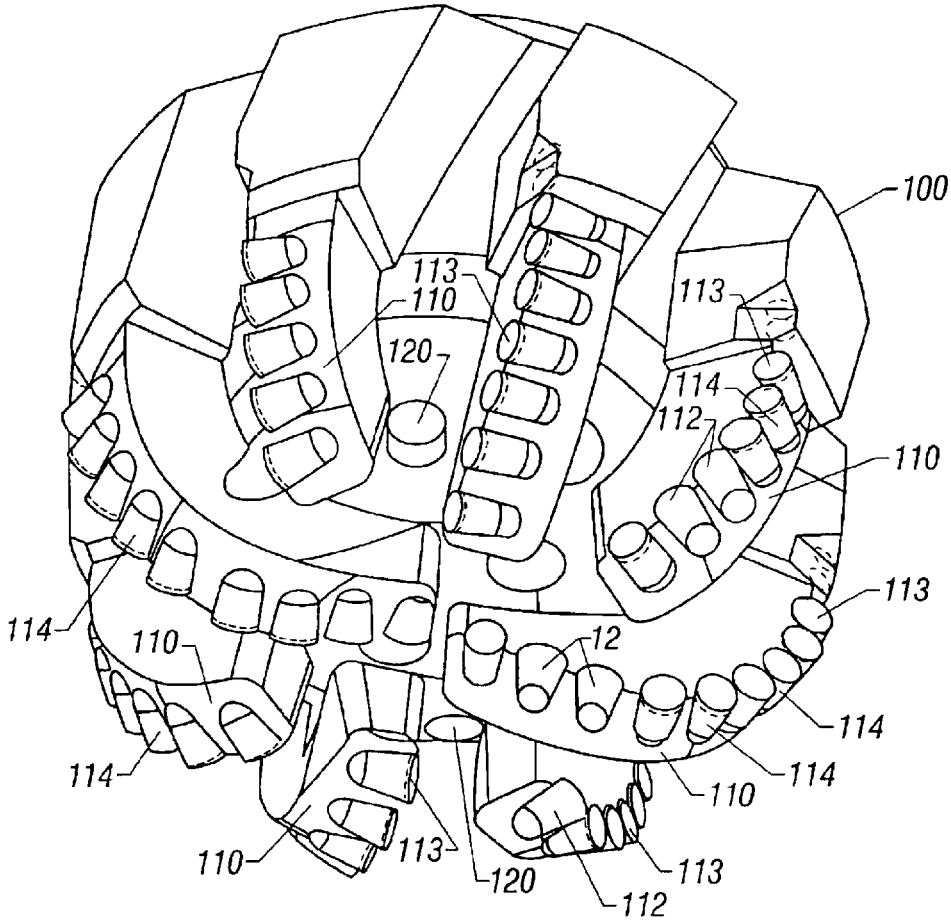
FIG. 4 shows an example of a PDC drill bit made according to the invention.

In a drill bit body made according to the invention, a displacement such as shown in FIGS. 1 and 2 is positioned in the mold at each place where a cutting element is to be mounted. Each mounting pad thus formed in the bit body will have a relief groove such as shown in FIG. 3. An example of a PDC cutter drill bit made according to the invention is shown in FIG. 4. The bit body 100 has thereon a plurality of blades 110. Each of the blades 110 has mounted thereon on a plurality of mounting pads (each shaped according to FIG. 3). Each of the mounting pads has thereon a PDC cutting element 112. Each PDC cutting element 112 includes a diamond table 113 affixed to a tungsten carbide substrate 114. The bit body 100 includes suitably positioned nozzles or "jets" 120 to discharge drilling fluid in selected directions and at selected rates of flow.

The foregoing embodiments of the invention are directed to bit bodies being formed by infiltrating powdered tungsten carbide with a binder alloy in a suitable mold. In other embodiments of the invention, a bit body such as shown at 100 in FIG. 4 can be made from steel or other alloy which can be machined or otherwise cut and finished formed using conventional machining and/or grinding equipment. In this embodiment, a bit body "blank" is rough formed such as by casting or forging, and is finished machined to include at least one of the blades 110 having mounting pads for cutting elements. In this embodiment, and referring again to FIG. 3, the mounting pads 25 are formed by grinding or machining to include a relief groove 26. In embodiments of the invention which have a bit body that is finish machined from a bit body blank, the relief grooves 26 may have any suitable width, but preferably have about the same width as in the previous embodiments including the infiltration-molded bit body.

A drill bit made according to the invention can have reduced breakage of diamond tables on the cutting elements as compared with prior art drill bits made without such relief grooves. Such bits may provide increased bit life and reduced drilling costs.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A drill bit body comprising:

a main body having at least one blade formed therein; and at least one cutting element mounting pad formed on the at least one blade, the mounting pad adapted to receive therein a substrate of a cutting element, the mounting pad having a relief groove therein under a position of a diamond table in the cutting element when the cutting element is mounted on the pad, a width of the relief groove selected so that the relief groove extends back from an outer surface of the blade at least about 40 percent of that portion of a thickness of the diamond table which does not extend past the outer surface.

2. The drill bit body as defined in claim 1, wherein the bit body is formed from powdered tungsten carbide infiltrated by a binder alloy.

3. The drill bit body as defined in claim 1 wherein the relief groove has a depth of 0.025 inches.

4. A drill bit comprising:

a bit body having a plurality of blades formed therein; and a plurality of cutting elements mounted on each of the blades, each cutting element mounted on a cutting element mounting pad formed on one of the blades, the mounting pad adapted to receive therein a substrate of the cutting element, the mounting pad having a relief groove therein under a position of a diamond table in the cutting element when the cutting element is mounted on the pad, a width of the relief groove selected so that the relief groove extends back from an outer surface of the blade at least about 40 percent of that portion of a thickness of the diamond table which does not extend past the outer surface.

5. The drill bit as defined in claim 4 wherein the bit body comprises powdered tungsten carbide infiltrated with a binder alloy.

6. The drill bit as defined in claim 4 wherein each of the relief grooves has a depth of about 0.025 inches.

7. A drill bit body comprising:

a main body having at least one blade formed therein; and at least one cutting element mounting pad formed on the at least one blade, the mounting pad adapted to receive therein a substrate of a cutting element, the mounting pad having a relief groove therein under a position of a diamond table in the cutting element when the cutting element is mounted on the pad, the drill bit body formed by machining a bit body blank.

* * * * *